US010590644B2

(12) United States Patent
Naylor et al.

(10) Patent No.: US 10,590,644 B2
(45) Date of Patent: Mar. 17, 2020

(54) UNIVERSAL MOUNTING SYSTEM

(71) Applicant: BÖK MODERN, LLC, San Francisco, CA (US)

(72) Inventors: Russell Naylor, San Francisco, CA (US); Hearee Chu, San Francisco, CA (US)

(73) Assignee: BÖK Modern LLC, San Francisco, CA (US)

( * ) Notice: Subject to any disclaimer, the term of this patent is extended or adjusted under 35 U.S.C. 154(b) by 0 days.

(21) Appl. No.: 16/044,394

(22) Filed: Jul. 24, 2018

(65) Prior Publication Data

US 2019/0136512 A1 May 9, 2019

Related U.S. Application Data

(60) Provisional application No. 62/536,219, filed on Jul. 24, 2017.

(51) Int. Cl.

| | |
|---|---|
| ***E04B 1/66*** | (2006.01) |
| ***E04B 2/72*** | (2006.01) |
| ***E04B 1/70*** | (2006.01) |
| ***E04B 1/26*** | (2006.01) |
| *E04B 1/38* | (2006.01) |

(52) U.S. Cl.

CPC ..... *E04B 1/66* (2013.01); *E04B 1/2604* (2013.01); *E04B 1/7038* (2013.01); *E04B 2/721* (2013.01); *E04B 1/2612* (2013.01); *E04B 2001/2644* (2013.01); *E04B 2001/405* (2013.01)

(58) Field of Classification Search

CPC ..... E04B 1/40; E04B 1/7038; E04B 1/2604; E04B 2/721; E04B 2001/2644; E04B 1/2612; E04B 2001/405; E04B 1/66

USPC .. 52/283, 506.01, 506.05, 506.08, 512, 474, 52/379, 489.2, 511, 513, 698; 248/235, 248/250

See application file for complete search history.

(56) References Cited

U.S. PATENT DOCUMENTS

| | | | | | |
|---|---|---|---|---|---|
| 750,595 | A * | 1/1904 | Campbell | A47B 96/027 | 248/250 |
| 2,860,504 | A * | 11/1958 | Sinner | E04F 13/0846 | 52/378 |
| 3,342,005 | A * | 9/1967 | Rickards | E04F 13/0846 | 52/702 |

(Continued)

*Primary Examiner* — Brian E Glessner
*Assistant Examiner* — Adam G Barlow
(74) *Attorney, Agent, or Firm* — Run8 Patent Group, LLC; Alexander R. Flake

(57) ABSTRACT

A universal mounting system can include: a mount, a bracket, and a panel. The mount includes a horizontal flange defining a first array of bores; a vertical flange extending below and substantially perpendicular to the horizontal flange and defining an outer broad face and a second array of bores across the outer broad face; a vertical capture channel arranged on the outer broad face; an upper threaded fastener captured by the vertical capture channel; and a lower threaded fastener captured by the vertical capture channel below the upper threaded fastener. The bracket includes a first slot and a second slot; and an upper receiver and a lower receiver offset below the upper receiver arranged perpendicular to the first and second slot. The bracket is configured to fasten to the upper threaded fastener via the first slot and to fasten to the lower threaded fastener via the second slot.

20 Claims, 9 Drawing Sheets

(56) References Cited

U.S. PATENT DOCUMENTS 3,388,518 A * 6/1968 Scott ..... E04B 2/58 52/478
4,107,887 A * 8/1978 Wendt ..... E04B 1/86 52/105
5,265,396 A * 11/1993 Amimoto ..... E04F 13/0855 52/235
5,857,295 A * 1/1999 Mikawa ..... E04B 7/045 52/656.9
6,170,214 B1 * 1/2001 Treister ..... E04F 13/0808 52/235
6,536,729 B1 * 3/2003 Haddock ..... E04B 1/66 248/200
6,837,019 B2 * 1/2005 Collie ..... E04B 7/063 52/489.1
6,973,756 B2 * 12/2005 Hatzinikolas ..... E04F 13/0855 52/235
7,971,410 B2 * 7/2011 Jerke ..... E04H 9/14 52/702
8,769,901 B2 * 7/2014 Todd ..... E04F 13/0805 52/483.1
8,893,452 B2 * 11/2014 Hatzinikolas ..... E04B 1/4178 52/712
9,091,056 B2 * 7/2015 Stauffer ..... E04B 1/40
9,115,489 B2 * 8/2015 Bourdon ..... E04B 2/90
2002/0043037 A1 * 4/2002 Dorsey ..... E04F 13/0864 52/506.05
2003/0150179 A1 * 8/2003 Moreno ..... E04F 13/0808 52/235
2009/0193750 A1 * 8/2009 Klima ..... E04B 2/96 52/712
2009/0235603 A1 * 9/2009 Bergman ..... E04B 9/20 52/506.08
2011/0094176 A1 * 4/2011 Bronner ..... E04B 1/4178 52/506.05
2012/0285111 A1 * 11/2012 Johnson, III ..... E04B 1/4178 52/379
2013/0014465 A1 * 1/2013 Kilgore ..... E04F 15/02044 52/650.3
2014/0190109 A1 * 7/2014 Bergman ..... E04B 9/225 52/506.05
2018/0066424 A1 * 3/2018 Daudet ..... E04B 1/40
2018/0066425 A1 * 3/2018 Ralph ..... E04B 1/2403
2018/0135293 A1 * 5/2018 Daudet ..... E04B 2/768

* cited by examiner

UNIVERSAL MOUNTING SYSTEM

CROSS-REFERENCE TO RELATED APPLICATIONS

This Application claims the benefit of U.S. Provisional Application No. 62/536,219, filed on 24 Jul. 2017, which is incorporated in its entirety by this reference.

TECHNICAL FIELD

This invention relates generally to the field of architectural panels and more specifically to a new and useful universal mounting system in the field of architectural panels.

DESCRIPTION OF THE EMBODIMENTS

The following description of the embodiments of the invention is not intended to limit the invention to these embodiments but rather to enable a person skilled in the art to make and use this invention. Variations, configurations, implementations, example implementations, and examples described herein are optional and are not exclusive to the variations, configurations, implementations, example implementations, and examples they describe. The invention described herein can include any and all permutations of these variations, configurations, implementations, example implementations, and examples.

1. Universal Mounting System

Figure 1A:
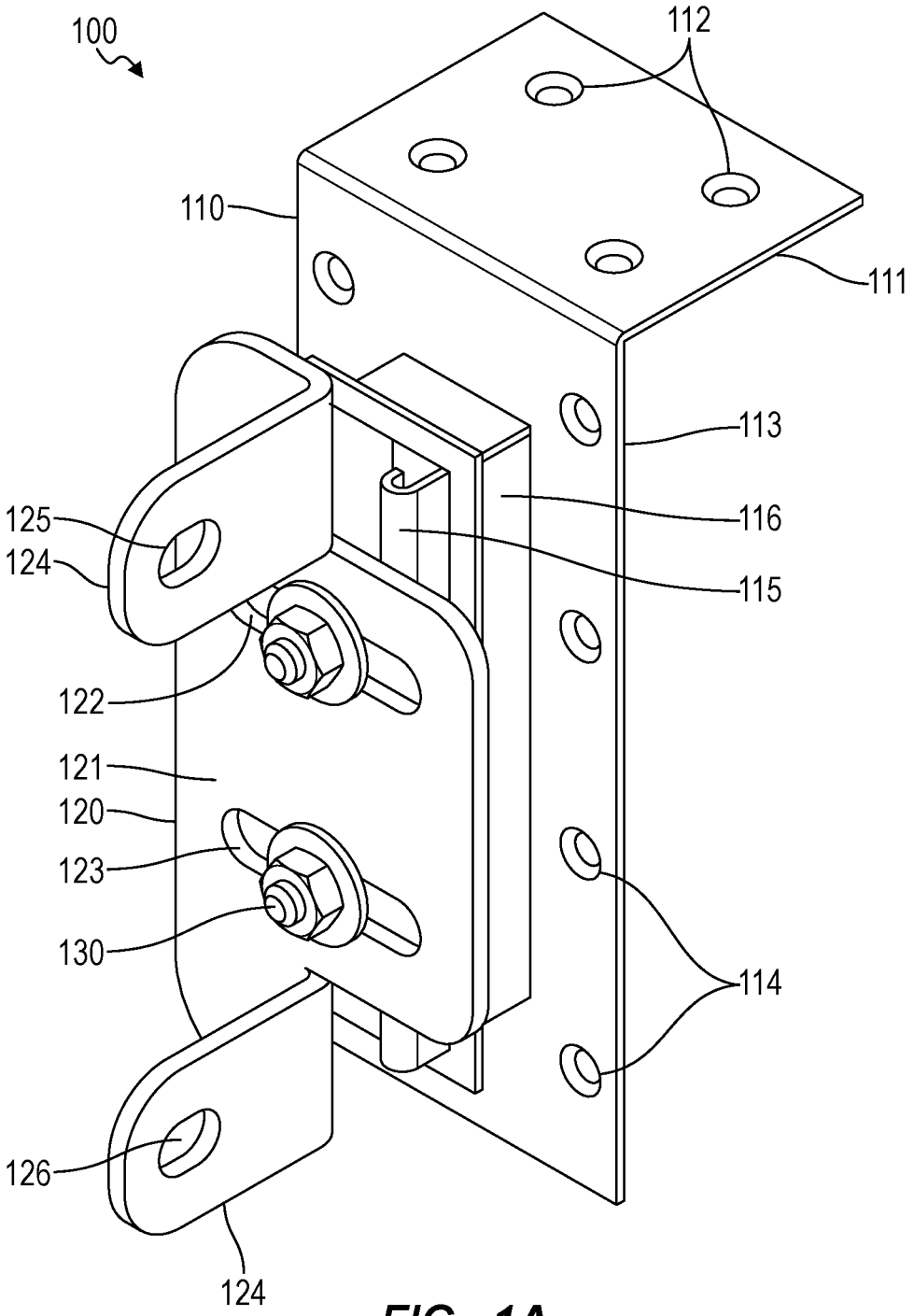
FIGS. 1A and 1B are schematic representations of a universal mounting system.
Figure 1B:
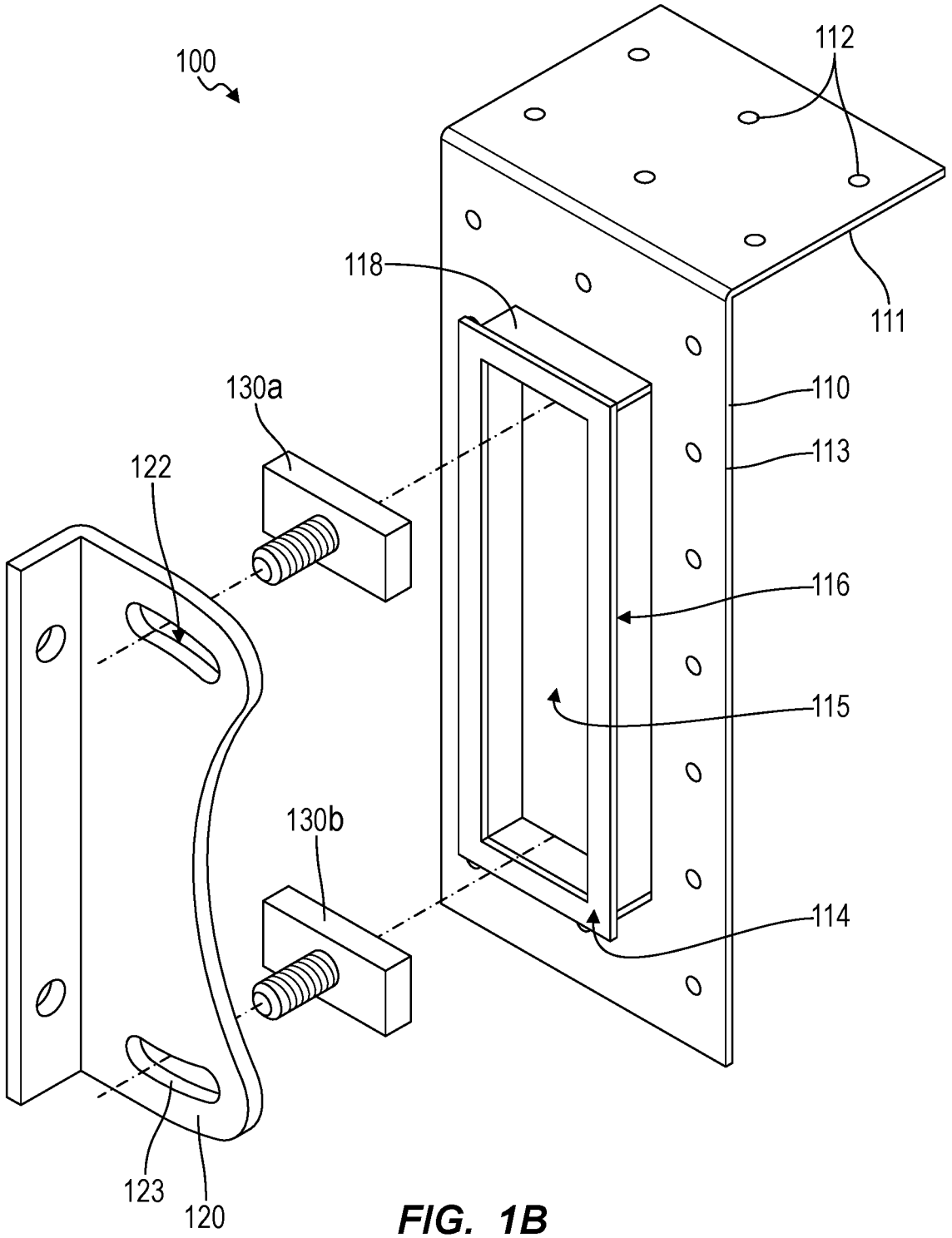

As shown in FIGS. 1A and 1B, a universal mounting system can include: a mount, a bracket, and a panel. The mount includes a horizontal flange defining a first array of bores; a vertical flange extending below and substantially perpendicular to the horizontal flange and defining an outer broad face and a second array of bores across the outer broad face; a vertical capture channel arranged on the outer broad face; a return flange extending from a perimeter of the vertical capture channel and substantially parallel to and offset from the outer broad face; an upper threaded fastener captured by and running in the vertical capture channel; and a lower threaded fastener captured by and running in the vertical capture channel below the upper threaded fastener. The bracket includes a first member defining a first slot and a second slot; and a second member extending from and substantially perpendicular to the first member and defining an upper receiver and a lower receiver offset below the upper receiver. The bracket is configured to fasten to the upper threaded fastener via the first slot and to fasten to the lower threaded fastener via the second slot. The panel includes a projection defining an open slot and a closed slot and configured to fasten to the upper receiver of the second member via the open slot and to fasten to the lower receiver of the second member via the closed slot.

Figure 2A:
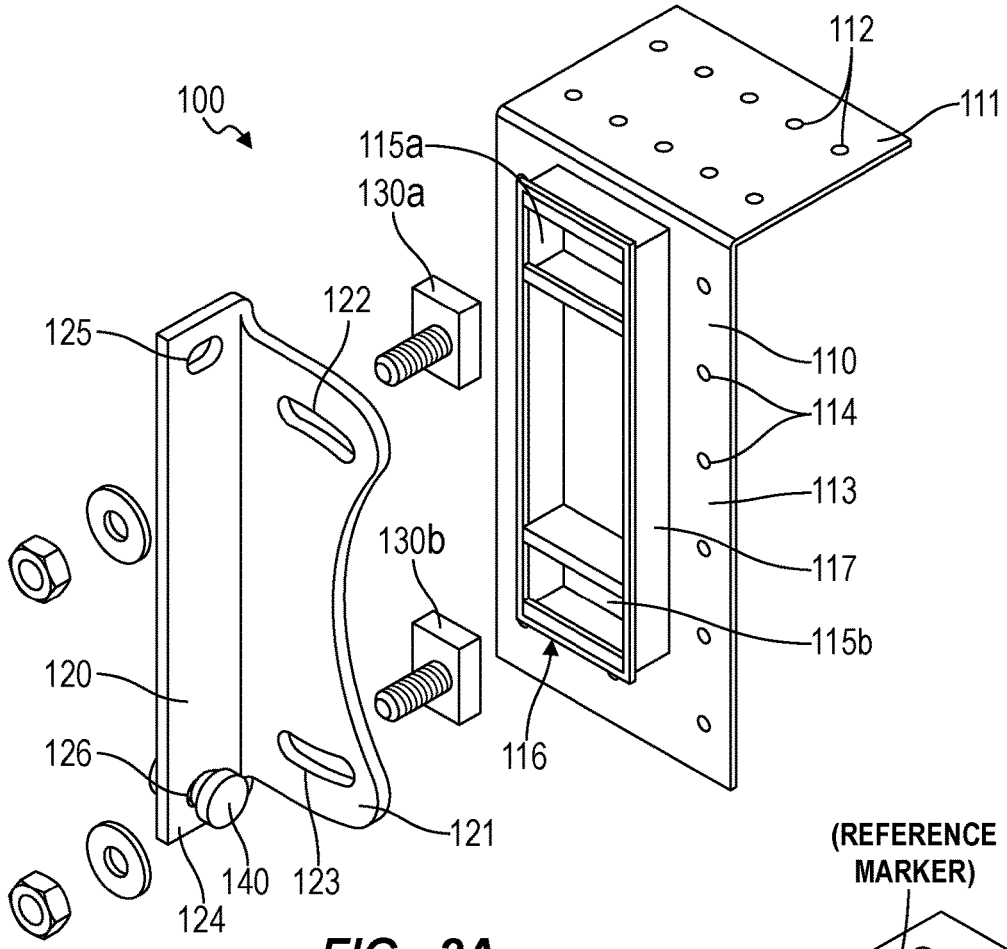
FIGS. 2A and 2B are schematic representations of one variation of the universal mounting system.
Figure 3A:
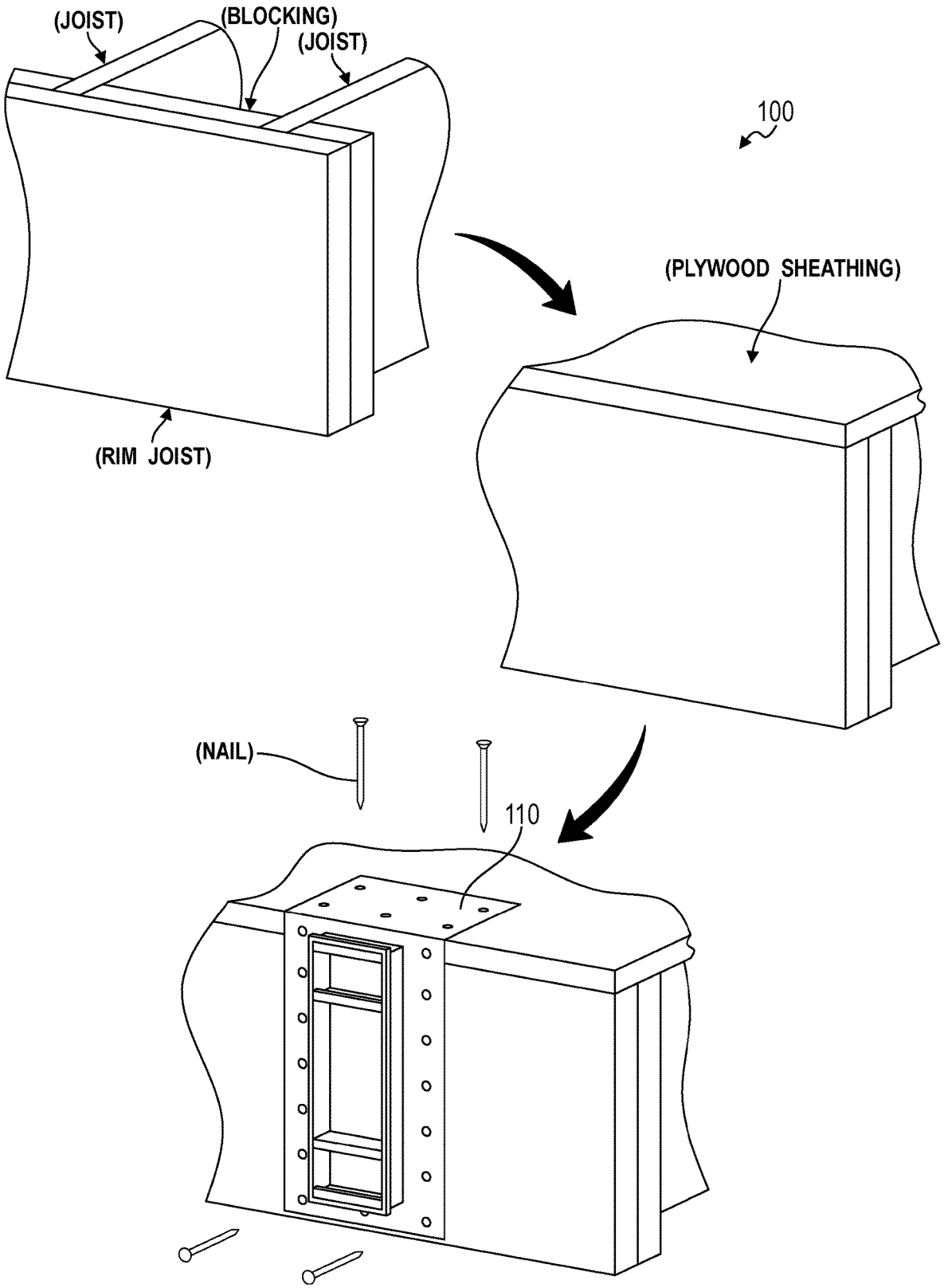
FIGS. 3A, 3B, and 3C are flowchart representations of one variation of the universal mounting system.
Figure 3B:
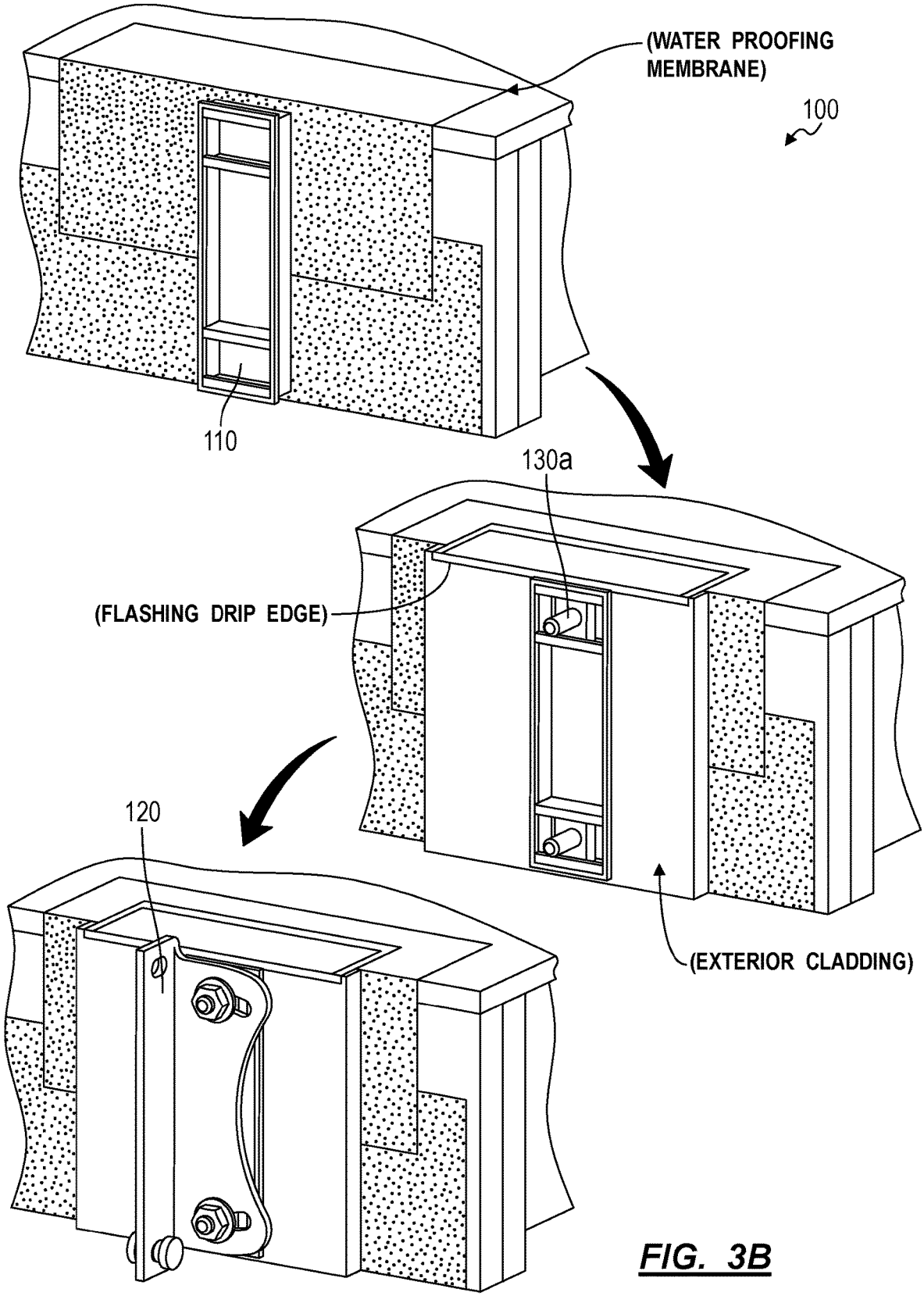
Figure 3C:
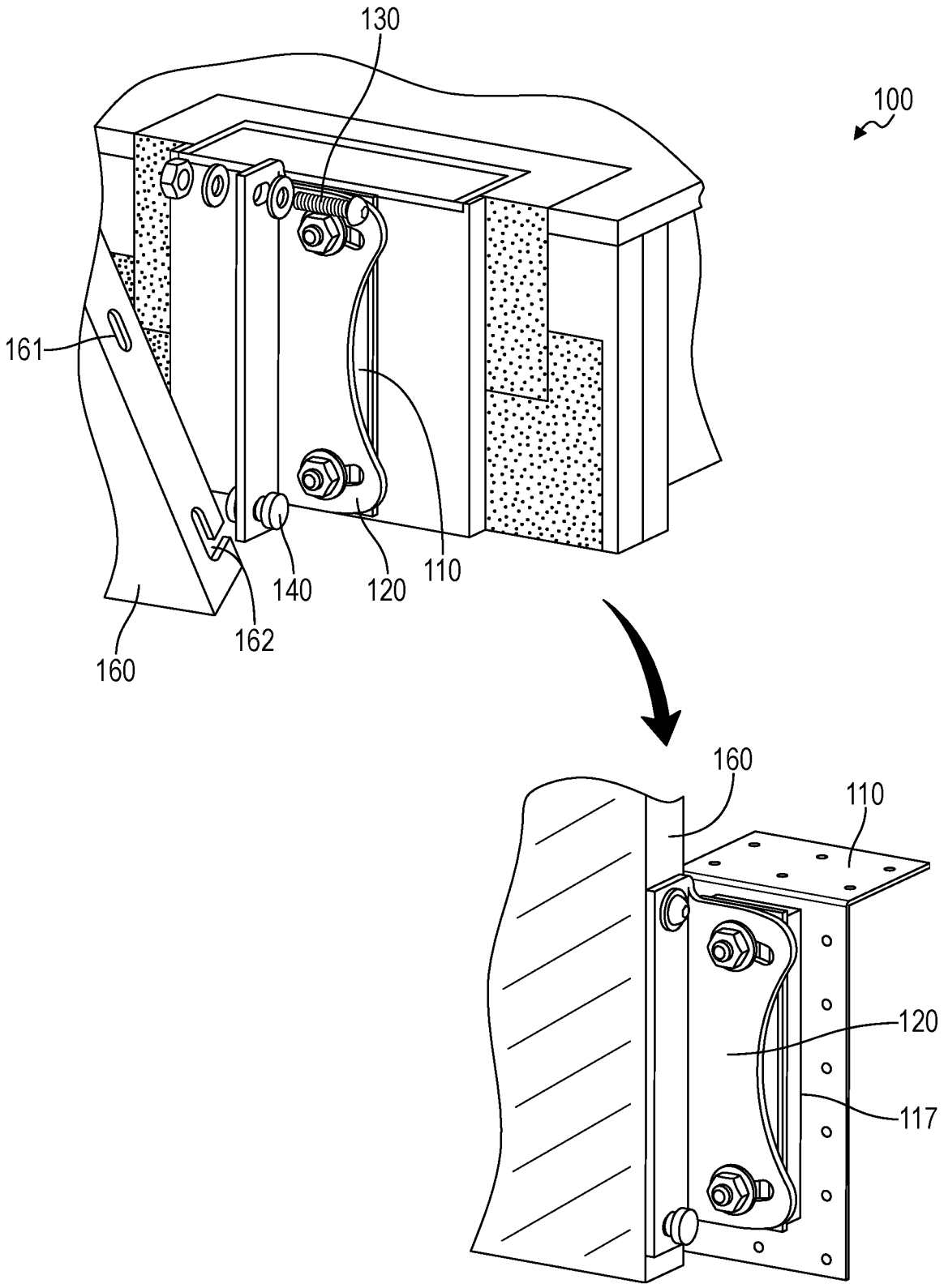

As shown in FIGS. 2A and 3C, one variation of the universal mounting system can include a mount, a bracket, and a panel. The mount includes: a horizontal flange defining a first array of bores; a vertical flange extending below and substantially perpendicular to the horizontal flange, defining an outer broad face and a second array of bores across the outer broad face; an upper horizontal capture channel arranged on the outer broad face; a lower horizontal capture channel arranged on the outer broad face below and parallel to the upper horizontal capture channel; an annular eave extending from the outer broad face and arranged about the upper capture channel and the lower capture channel; an upper threaded fastener captured by and running in the upper horizontal capture channel; and a lower threaded fastener captured by and running in the lower horizontal capture channel. The bracket includes: a first member defining a first radial slot and a second radial slot; a second member extending from and substantially perpendicular to the first member and defining an upper receiver and a lower receiver offset below the upper receiver. Additionally, the bracket is configured to fasten to the upper threaded fastener via the first slot and to fasten to the lower threaded fastener via the second slot. The panel includes a projection defining an open slot and a closed slot configured to receive a set of fasteners passing through the upper receiver and the lower receiver.

2. Applications

Figure 4:
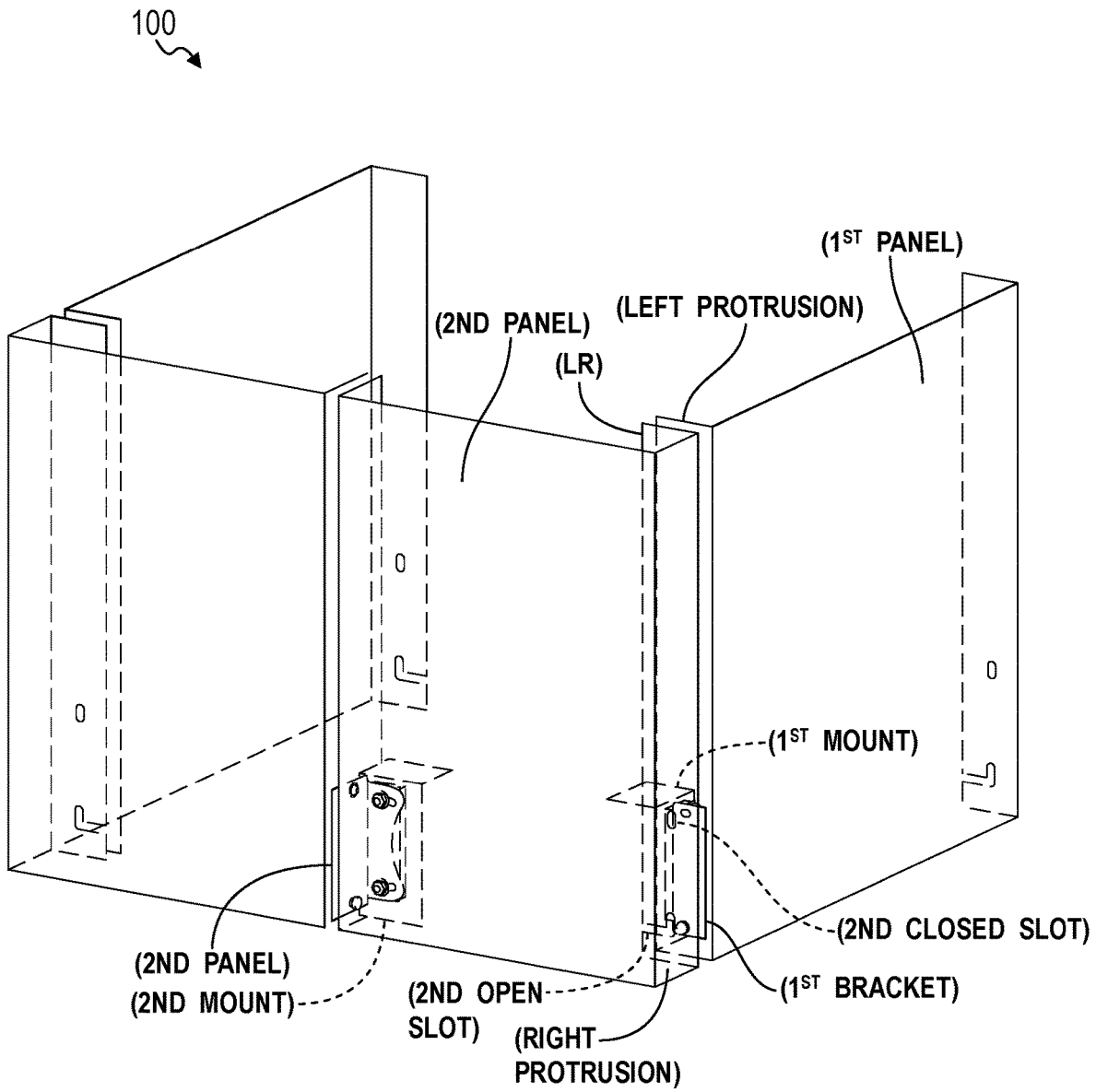
FIG. 4 is a schematic representation of one variation of the universal mounting system.

Generally, the universal mounting system 100 functions as a railing system and can be installed in deck, balcony, handicap ramp, staircase, and/or other applications to mount and secure a guardrail panel 160, such as shown in FIGS. 4 and 6. The universal mounting system 100 includes a mount 110, a bracket 120, and a panel 160 that cooperate to accommodate a range of lateral, longitudinal, depth, pitch, yaw, and roll adjustments for the panel 160 in order to compensate for inconsistencies in construction of buildings and other structures and to permit use of a single type and form of mounting bracket 120 across multiple unique applications within one building or other structure, such as to mount horizontal balcony railing, to mount pitched stair railing, and to mount fencing panels on a varying slope. For example, the universal mounting system 100 can accommodate a range of lateral, longitudinal, and depth positions and a range of pitch, yaw, and roll angles to permit sets of panels 160 of a single stock dimension (or panels 160 of a limited number of stock or custom dimensions) to be installed in a project without sacrificing fit, alignment, parallelism, and gapping of adjacent panels 160 across the project.

The universal mounting system 100 also defines a geometry that carries shear forces predominantly in the mount 110 rather than in fasteners that attach the mount 110 to a substrate (e.g., a floor joist, a rim joist, a concrete slab, a steel structural member, etc.) such that the universal mounting system 100 may be installed with common construction fasteners (e.g., wood screws, concrete anchors, masonry screws, nails) driven into a substrate with common construction tools (e.g., a drill, a hammer) without significant modification to the substrate (e.g., setting of large anchors). In particular, the mount 110 includes a horizontal flange 111 and a vertical flange 113, each of which defines an array of bores configured to accept a fastener. When the mount 110 is installed over a horizontal corner of a substrate at the junction of floor sheathing and a rim joist, the horizontal flange 111 can be fastened to the floor sheathing by a set of fasteners (e.g., wood screws), and the vertical flange 113 can be fastened to the rim joist by a similar set of fasteners, as shown in FIG. 3A. The horizontal flange 111 can thus rest on and carry vertical loads (e.g., due to gravity) into the floor sheathing, which may reduce vertical shear loads on fasteners connecting the vertical flange 113 to the rim joist. Similarly, the vertical flange 113 can carry horizontal loads into the rim joist (e.g., due to wind loads or a human imparting a horizontal force on a panel 160 installed on the mount 110), which may reduce horizontal shear loads on fasteners connecting the horizontal flange 111 to the floor sheathing. The geometry of the mount 110 can also ensure that a torque—applied to a panel 160 connected to the mount 110 via the bracket 120—is carried as a tensile load on fasteners passing through one of the vertical flange 113 and the horizontal flange 111. Because the mount 110 carries downward vertical loads directly into the floor sheathing, communicates inward horizontal loads directly into the rim joist, and defines a geometry that transforms vertical loads, horizontal loads, and torques on the mount 110 into tensile loads on a suitable proportion of fasteners connecting the mount 110 to the floor sheathing and rim joist, thereby compensating for lower carrying capacity of screws in shear and enabling the mount 110 to be reliably installed on the substrate with wood screws (e.g., rather than lag bolts, threaded rod, or other large anchors or fasteners).

Figure 5:
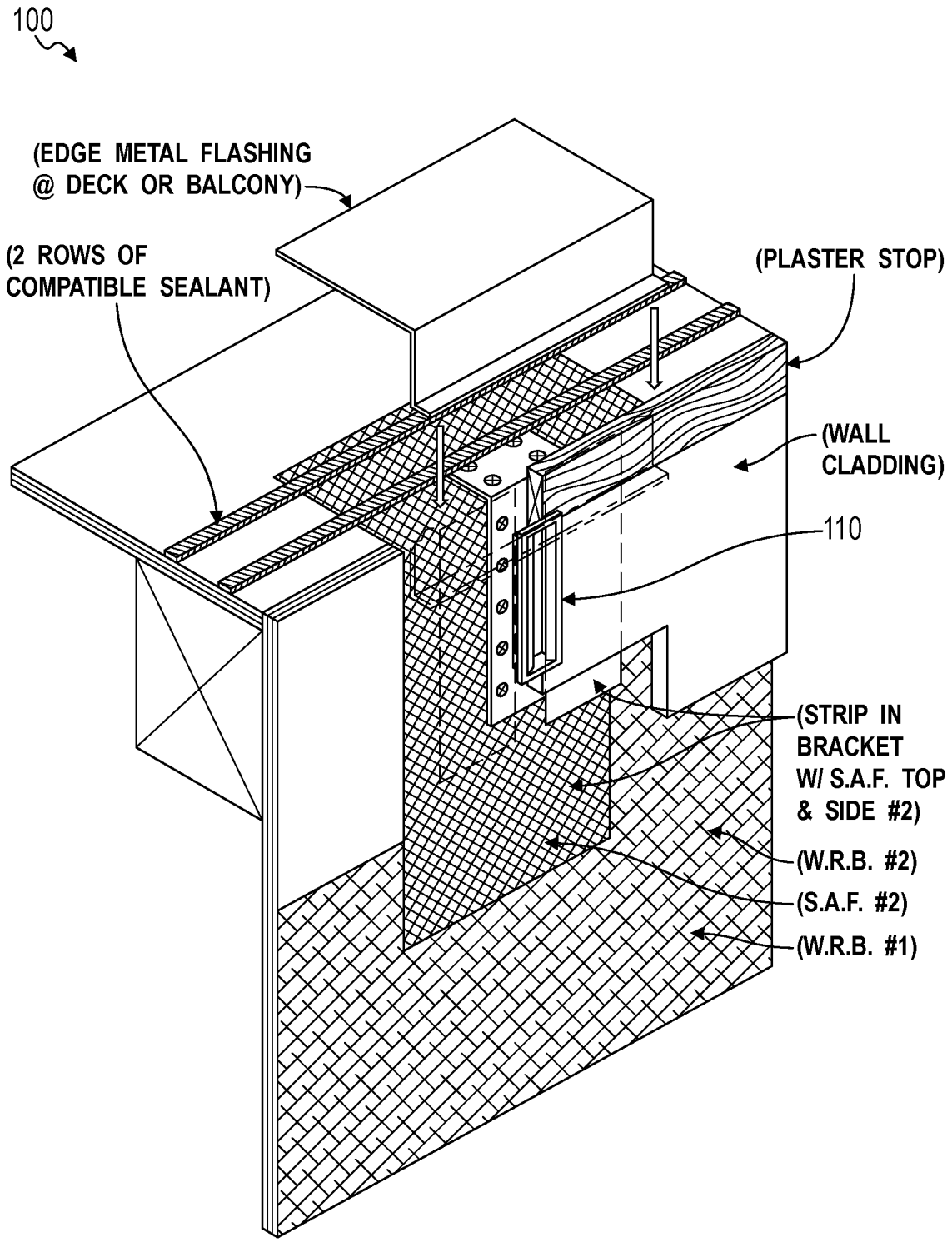
FIG. 5 is a schematic representation of one variation of the universal mounting system.

Furthermore, because the mount 110 enables installation with screws rather than with larger, more obtrusive fasteners, a waterproofing membrane or other vapor barrier may be installed over the mount 110 and these fasteners up to the return flange 116, as shown in FIG. 5, without risking perforation of the waterproofing membrane by these fasteners and without necessitating caulk or other liquid sealant to waterproof around these fasteners. Because a total thickness of the mount 110, countersunk fasteners, and the waterproofing membrane installed over the mount 110 may be relatively minimal (e.g., less than ¼"), an exterior façade (e.g., stucco, metal siding, or lap board, etc.) installed on the substrate can be extended over the mount 110 up to the return flange 116 to yield a seamless, waterproof installation in which only the capture channel of the mount 110 is visible prior to installation of the bracket 120 and panels 160. The bracket 120 and panel 160 can then be fitted to the capture channel(s) on the mount 110, set in alignment with other instances of the bracket 120 installed on the project, and tightened to yield a seamless and watertight railing.

For brevity, the universal mounting system 100 is described herein as configured for installation on a balcony. However, the universal mounting system 100 can be similarly installed on a deck, a handicap ramp, a staircase, or an elevated platform, etc. Furthermore, a single mount 110 ("the mount 110"), a single bracket 120 ("the bracket 120") and a single panel 160 ("the panel 160") are described herein; however, the universal mounting system 100 can include any number of identical, similar, or dissimilar mounts 110, brackets 120, and/or panels 160, each including any permutation of features and elements described herein.

3. Installation

Figure 6A:
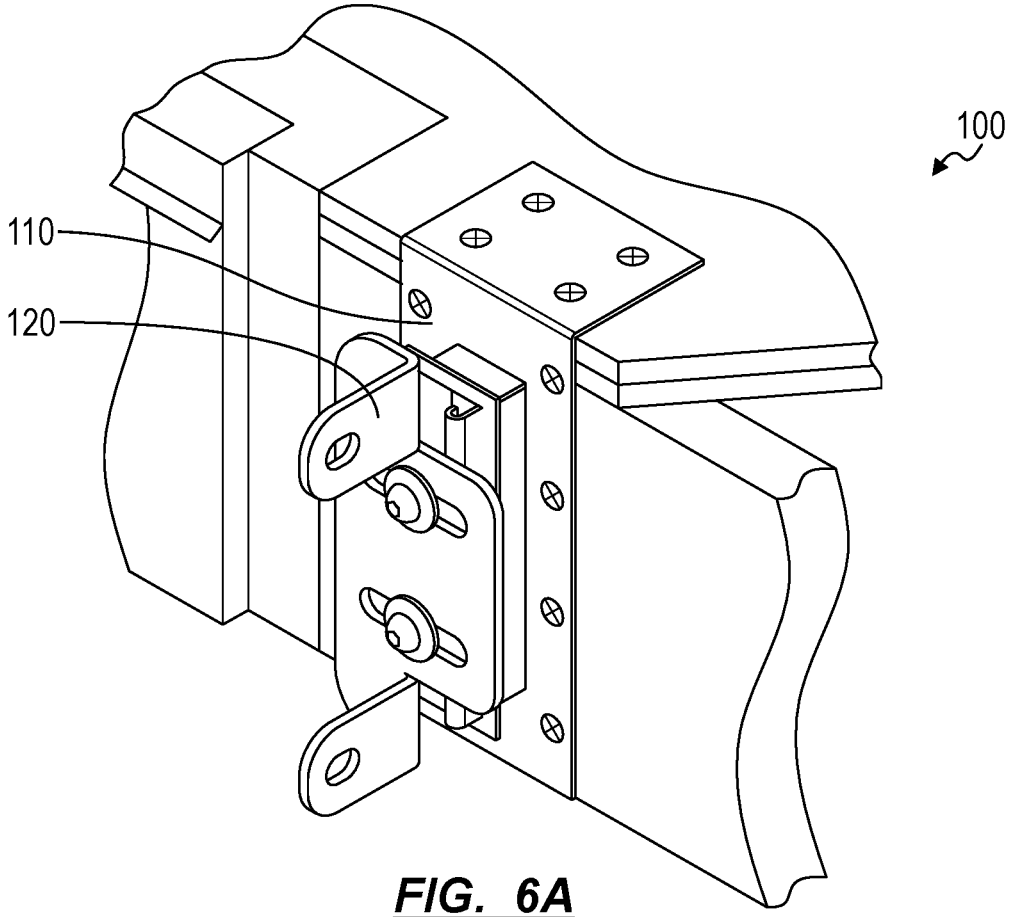
FIGS. 6A and 6B are schematic representations of one variation of the universal mounting system.
Figure 6B:
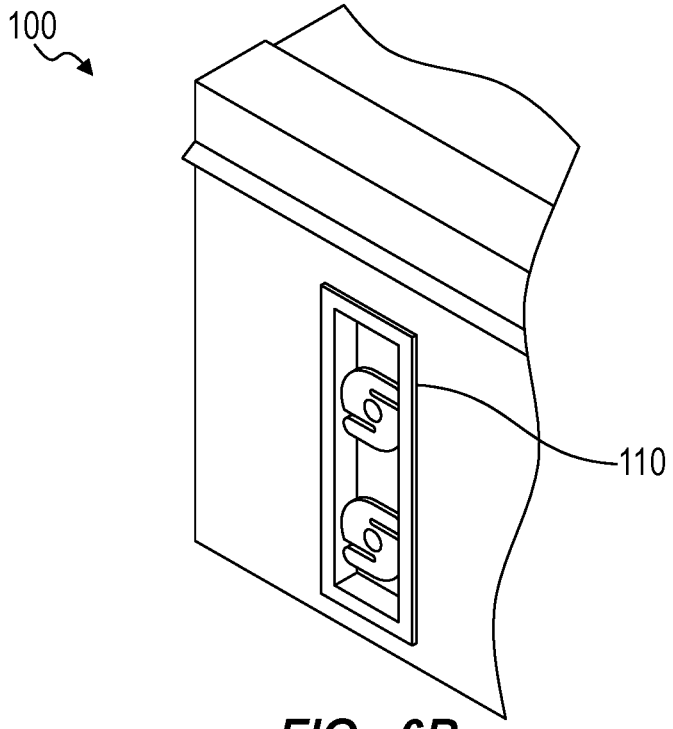

In one example application, the universal mounting system 100 is installed on a balcony constructed with dimensional wood joists, including double-wide outer floor joists and a double-wide rim joist (or a rim joist with blocking, as shown in FIG. 3A). In this example application, once the balcony framing is completed and floor sheathing is installed thereover, a set of mounts 110 is fastened to the balcony with a set of fasteners, such as screws or nails, as shown in FIG. 3A. For example, for the balcony that is cantilevered from a wall and is of a standard width and depth (e.g., 48 inches square), four mounts no can be installed on the balcony, including one mount 110 at each end of the right and left outer floor joists. For a larger balcony, additional mounts 110 can be installed along the floor and rim joists. For example, for a balcony that is 48 inches deep and 96 inches wide, the universal mounting system 100 can include five mounts 110 installed on the balcony, including one mount 110 at each end of the right and left outer floor joists and one mount 110 installed near the lateral center of the rim joists, as shown in FIG. 4. A moisture barrier is then installed over the sheathing, over the floor and rim joists, and over each mount 110 up to the return flanges 116 extending from the vertical flange 113 of each mount 110 in the universal mounting system 100, as shown in FIG. 5. Exterior cladding—such as stucco, a metal rainscreen panel 160, or wood siding—is then installed over the moisture barrier and up to the perimeter of each return flange 116, as shown in FIGS. 3B and 6B. In particular, because the vertical and horizontal flanges 113 can be relatively thin, exterior cladding can be installed over each mount 110 with minimal effect on the continuity and parallelism of the cladding. Scaffolding previously assembled around the balcony can then be removed and finishing details for the exterior cladding can be completed. Field measurements for the universal mounting system 100 can then be recorded, such as including offset distances between the adjacent mounts 110; panels 160 can then be ordered according to the field measurements, such as a single panel 160 size or a limited number of panel 160 sizes that will meet fit (e.g., parallelism, gapping) specifications given known adjustment ranges of the mounts 110.

At a later time, a sex bolt 140 (or barrel nut, etc.) is installed in the lower receiver 126 of each bracket 120 in the universal mounting system 100, and a bracket 120 is fitted over the threaded studs of a corresponding mount 110 previously installed on the balcony; a pair of washers and nuts are then installed over the threaded studs and finger-tightened to anchor each bracket 120 to a corresponding mount 110. Starting at one end of the balcony, an installer standing on the balcony and over the mounts 110 can then lower a panel 160 into position on two adjacent brackets 120 by: slipping the open slot 162 on each projection of the panel 160 over the sex bolts 140 installed in the lower receivers 126 of the adjacent brackets 120; pivoting the panel 160 into a substantially vertical orientation to align the closed slots 161 on each side of the panel 160 with the upper receivers 125 of the adjacent brackets 120; with one hand holding the panel 160 upright, slipping a threaded fastener through the upper receiver 125 of the bracket 120 at the end of the balcony and through the corresponding closed slot of the panel 160; and installing a nut and washer over the threaded fastener to retain the panel 160 against the bracket 120 at the end of the balcony, such as shown in FIG. 3C. The installer can similarly install adjacent panels 160 in the universal mounting system 100 in series. Once the remainder of the panels 160 in the universal mounting system 100 are loosely installed, the installer aligns (e.g., squares) the panels 160 before tightening threaded fasteners across the universal mounting system 100, such as up to a specified torque with a torque wrench.

4. Mount

The mount 110 of the universal mounting system 100 includes a horizontal flange 111, a vertical flange 113, a vertical capture channel 115, a return flange 116, an upper threaded stud 130A, and a lower threaded stud 130B, as shown in FIG. 2A. Generally, the mount 110 defines a nail-on (or screw-on) angle section configured for installation over the corner of a substrate (e.g., a double-wide two-by floor joist or rim joist) at the end of a series of panels 160 or at the junction of two panels 160. For example, the mounts 110 can be configured for installation over a concrete substrate, wood joists, or steel joists.

4.1 Flanges

Figure 2B:
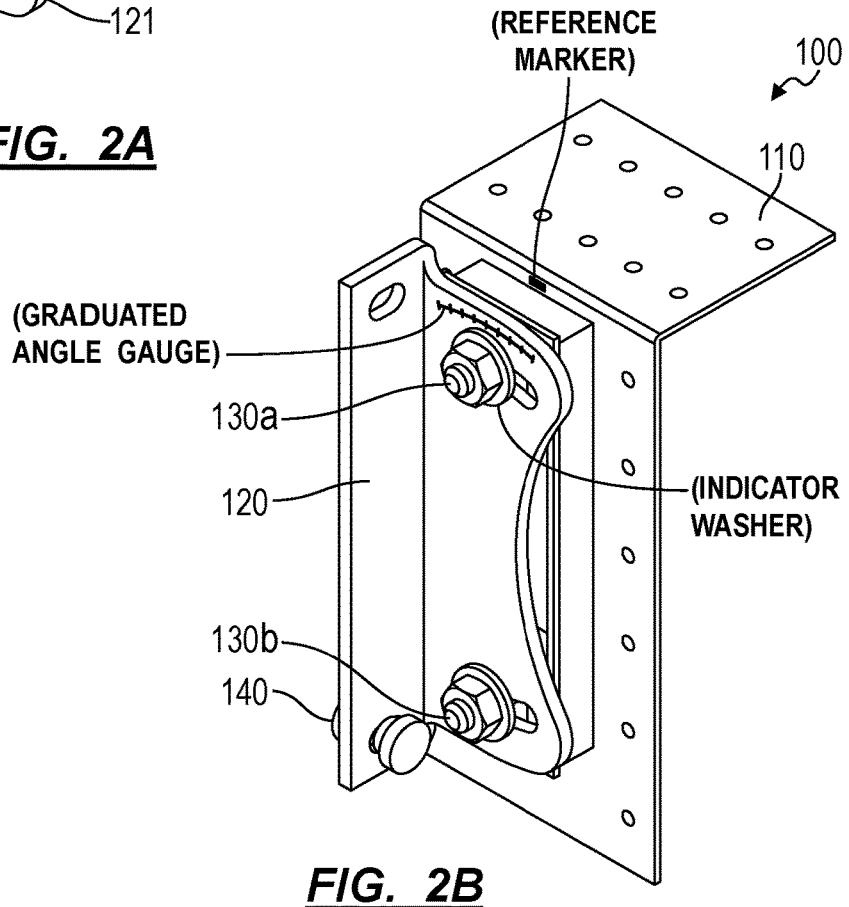

The mount 110 includes a horizontal flange 111 configured to rest on a substantially horizontal surface of the substrate and to transfer vertical loads into the adjacent substrate through compression. In one implementation in which the universal mounting system 100 is configured for installation on a wood joist substrate, the horizontal flange 111 can include an array of bores defining two rows of bores spaced along the horizontal flange 111 and substantially parallel to the corner of the mount 110, as shown in FIG. 2B. In this implementation, the first row of bores can be offset from the corner of the mount 110 by half of a standard two-by width (e.g., 0.75") such that nails driven through this first row of bores are substantially centered along the outer two-by rim joist; and the second row of bores can be offset from the first row—opposite the end of the mount 110—by the standard two-by width (e.g., 1.50") such that nails driven through the second row of bores are similarly centered in the inner two-by rim joist. In this implementation, the bores can be oversized for nails or screws specified for the mount 110 to provide clearance between these fasteners and the mount 110 in the event that the horizontal flange 111 drifts along the top surface of the substrate, such as due to temperature fluctuations that cause the wood joists to expand or contract or due to a force applied to the adjacent panel 160 that imparts a torque across the mount 110.

In another implementation, the first array of bores 112 can be distributed across the horizontal flange 111 according to a spacing that accommodates for sizes and spacing of rebar cast in an adjacent concrete structure. In this implementation, bores in the horizontal flange 111 can be sized to receive countersunk, self-tapping concrete anchors and can be countersunk such that installed fasteners are substantially flush with the outer broad face of the horizontal flange 111.

The mount 110 also includes a vertical flange 113 that extends below the horizontal flange 111. The vertical flange 113 can be perpendicular to the horizontal flange 111 for installation over a square structure, such as over a square balcony ledge, over a square deck ledge, over a square-edged staircase, or over a square-edged landing. Alternatively, the vertical flange 113 and the horizontal flange 111 can form any other included angle to seat over an edge of any other geometry. For example, the mount 110 can be configured for installation on the cantilevered edge of a balcony that slopes outwardly from a structure at an angle of 5° below horizontal. In this example, the interior face of the vertical flange 113 and the interior face of the horizontal flange 111 can define an included angle of 95° in order to seat squarely on the top of the balcony (e.g., on sheathing) and on the side of the balcony (e.g., on a rim or floor joist).

The horizontal flange 111 defines an outer broad face and a second array of bores 114 across the outer broad face, as shown in FIG. 2B. Like the first array of bores 112 in the horizontal flange 111, the second array of bores 114 in the vertical flange 113 can be configured to receive nails and/or screws to anchor the mount 110 to the face of an adjacent floor joist, rim joist, or other substrate.

The horizontal flange 111 and vertical flange 113 can cooperate to translate vertical loads and torques applied to the adjacent installed panel 160 into (predominantly) tensile forces across fasteners that anchor the mount 110 to a substrate. In particular, the fasteners anchoring the mount 110 to the substrate can remain predominantly in tension across a range of loads and torques applied to the installed panel 160, and the mount 110—rather than the fasteners—can carry a substantial portion of shear loads within the universal mounting system 100, such as along a junction between the horizontal and vertical flanges 113. For example, with a first set of fasteners passing through the first array of bores 112 normal to the horizontal flange 111 and a second set of fasteners passing through the second array of bores 114 normal to the vertical flange 113 thus anchoring the mount 110 to a substrate, the vertical load of the panel 160 on the mount 110 is transferred from the horizontal flange 111 directly into the substrate, the second set of fasteners remain in tension to prevent the horizontal flange 111 from sliding off of the substrate, and tension on the first set of fasteners remains relatively unchanged. Thus, the horizontal flange 111 carries a substantial portion of applied shear forces due to vertical loads on the universal mounting system 100 (e.g., rather than the second set of fasteners). Furthermore, in this example, when a lateral force is applied to either side of the panel 160, a moment (i.e., torque) is transferred into the mount 110; however, this moment is resisted by tension in the first and second sets of fasteners. The horizontal and vertical flanges 113 of the mount 110 can therefore cooperate to carry shear loads, thereby reducing diameter and length requirements for fasteners that anchor the mount 110 to a substrate—compared to fastener diameter and lengths necessitated by classical balustrade mounts no that excludes such a horizontal flange 111—to withstand target live loads and dead loads.

The mount 110 can be anchored to the substrate with one or more various types of fastener to satisfy load requirements for the installation. For example, the first and second arrays of bores in the horizontal flange 111 and vertical flange 113, respectively, can each include a linear array of twelve bores, and the mount 110 can be anchored to the substrate with 24 10-penny nails—which may sustain relatively large shear loads—driven through these bores. In another example, the mount 110 can be anchored to the substrate with a similar number of screws—which may sustain relatively large tensile loads—driven through and countersunk into these bores. The mount 110 can also be anchored to the substrate with a combination of screws and nails to achieve a target combination of tension and shear performance across the fasteners. For example, the first array of bores 112 can be configured to house nails driven through the horizontal flange 111 while the second array of bores 114 can be counter sunk to receive screws driven through the vertical flange 113 and into the substrate. Therefore, the nails fastening the horizontal flange 111 to the substrate can withstand the greater shear stresses affecting the horizontal flange 111, while the screws fastening the vertical flange 113 to the substrate can withstand the tensile stresses distributed across the vertical flange 113. However, the horizontal flange 111 and vertical flange 113 can define any other number of bores in any other pattern and configured to receive any other suitable type or combination of types of fasteners to anchor the mount 110 to a substrate.

4.2 Double Horizontal Capture Channels and Studs

In one variation shown in FIG. 2A, the mount 110 includes an upper capture channel 115A and a lower capture channel 115B arranged on the outer broad face of the vertical flange 113. Generally, each capture channel can include U-channel with opposing lips extending toward and closing a portion of the open valley along the U-channel. As described below, the upper threaded stud 130A can be installed in the upper capture channel 115A and can translate linearly along the upper capture channel 115A, and the opposing lips of the upper capture channel 115A can cooperate to retain the head of the upper threaded stud 130A within the U-channel. Thus, the upper threaded stud 130A can be tightened against the opposing lips of the upper capture channel 115A to anchor the bracket 120 to the mount 110. The opposing lips of the lower capture channel 115B can similarly cooperate to retain the head of the lower threaded stud 130B, and the lower threaded stud 130B can be similarly tightened against the opposing lips of the lower capture channel 115B to anchor the bracket 120 to the mount 110.

The upper capture channel 115A and lower capture channel 115B can be welded, brazed, or otherwise assembled onto the vertical channel of the mount 110 and can define parallel linear tracks through which corresponding threaded studs can slide when assembling and aligning one or more panels 160 on the mount 110, as shown in FIG. 2A. Each capture channel can be of a length equal to the sum of a target lateral adjustment and a width of a threaded stud installed therein. For example, each capture channel can be three inches wide to accommodate for two inches of lateral adjustment for a threaded stud with a one-inch-wide head. The upper capture channel 155A and lower capture channel 115B can also be substantially parallel to the corner of the mount 110 such that the upper threaded stud 130A and lower threaded stud 130B—and therefore the bracket 120 and the attached panel(s) 160—can be shifted laterally along the edge of the substrate (e.g., along the edge of a balcony). However, the upper capture channel 115A and lower capture channel 115B can be arranged on the vertical flange 113 in any other orientation.

As described above, the upper threaded stud 130A of the universal mounting system 100 is captured by and extends outwardly from the upper capture channel 115A, the lower threaded stud 130B of the universal mounting system 100 is captured by and extends outwardly from the lower capture channel 115B, and the upper threaded stud 130A and lower threaded stud 130B cooperate to attach the bracket 120 to the mount 110 within a range of lateral and roll positions, as shown in FIG. 2A. In one implementation, the upper threaded stud 130A and lower threaded stud 130B include square, rectangular, or polygonal heads defining maximum diameters greater than the internal heights of their respective capture channels such that the heads of the threaded studs interfere with and are thus constrained in rotation by the internal walls of their respective capture channels. Furthermore, the heads of the upper threaded stud 130A and lower threaded stud 130B can define minimum diameters (slightly) less than the internal heights of their respective capture channels such that the upper threaded stud 130A and lower threaded stud 130B can translate laterally within their respective capture channels. The upper threaded stud 130A and lower threaded stud 130B each include a threaded section extending outwardly from their respective capture channels such that the bracket 120 can be fit over the threaded studs and anchored to the bracket 120 with a pair of flat or lock washers and a pair of threaded nuts.

Alternatively, the universal mounting system 100 can include upper and lower threaded nuts or fasteners defining geometries similar to the heads of the threaded studs described above and similarly installed in the upper capture channel 115A and lower capture channel 115B. The bracket 120 can thus be anchored to the mount 110 by a pair of bolts passing through the first slot 122 and the second slot 123 in the bracket 120 and into the upper and lower nuts in the upper capture channel 115A and lower capture channel 115B.

4.3 Vertical Capture Channel

In another variation shown in FIG. 1, the mount 110 includes a single vertical capture channel 115 extending vertically along the vertical flange 113. As described above, the mount 110 can include: an upper threaded stud 130A (or upper threaded nut) running vertically within the vertical capture channel 115; and a lower threaded stud 130B (or lower threaded nut) below the upper threaded stud 130A and running vertically within the vertical capture channel 115. As described below, the bracket 120 can include a first slot 122 and a second slot 123 configured to accept the upper threaded stud 130A and lower threaded stud 130B (or bolts) to assemble onto the mount 110 and can be tightened onto the return flange 116 of the mount 110 with a pair of nuts (or with the bolts directly). The vertical capture channel 115 can define a length greater than the radial distance between the slots in the bracket 120 to accommodate vertical adjustment of the bracket 120 relative to the mount 110 (i.e., by sliding the upper threaded stud 130A and lower threaded stud 130B within the vertical capture channel 115 while maintaining constant vertical spacing between the upper threaded stud 130A and lower threaded stud 130B). The vertical capture channel 115 can also accommodate horizontal adjustment of the bracket 120 relative to the mount 110 by sliding the bracket 120 laterally, which causes the upper threaded stud and lower threaded stud 130B to move apart or closer together within the vertical capture channel 115 as the upper threaded stud 130A and lower threaded stud 130B run inside their respective slots in the bracket 120.

Therefore, in this variation, the mount 110 can include a single vertical capture channel 115 that accommodates both vertical and horizontal adjustment of the bracket 120 relative to the mount 110 while also defining a narrow profile that may be (nearly) fully obscured by the bracket 120 when installed.

4.4 Return Flange

The mount 110 further includes a return flange 116 extending from the outer broad face, arranged about the capture channel(s), and inset from a perimeter of the outer broad face. Generally, the return flange 116 defines a finish edge for exterior cladding installed over the outer broad face of the vertical flange 113.

In the variation described above in which the mount 110 includes an upper capture channel 115A and a lower capture channel 115B, the return flange 116 includes a continuous annular eave 117 extending from the outer broad face of the vertical flange 113 and configured to abut an edge of a moisture barrier and an edge of an exterior cladding installed over the horizontal flange 111. In this implementation, the return flange 116 can define a rectilinear extension set inside the perimeter of the outer broad face of the vertical flange 113. In one example in which the mount 110 includes an upper capture channel 115A and a lower capture channel 115B, the return flange 116 includes: a right eave (shown in FIG. 2A) extending from the top right corner of the upper capture channel 115A to the bottom right corner of the lower capture channel 115B; and a left eave extending from the top left corner of the upper capture channel 115A to the bottom left corner of the lower capture channel 115B. In this example, the left and right eaves can close the ends of the upper capture channel 115A and lower capture channel 115B, thereby constraining the upper threaded stud 130A and lower threaded stud 130B within their respective capture channels. In this example, the return flange 116 can also include: an upper eave 118 (shown in FIG. 2A) extending across the top of the upper capture channel 115A; and a lower eave 119 extending across the bottom of the lower capture channel 115B. The upper eave 118 and lower eave 119 can thus meet the right and left eaves to form a continuous annular eave 117 extending outwardly from the outer broad face of the vertical flange 113 and circumscribing the upper capture channel 115A and lower capture channel 115B.

The perimeter of the vertical flange 113 is offset beyond the perimeter of the return flange 116 by an offset distance, and the vertical flange 113 defines the second array of bores 114 between its perimeter and the perimeter of the return flange 116. In one example, the perimeter of the flange extends beyond the perimeter of the return flange 116 by at least a minimal overlap span specified for a moisture barrier (e.g., a waterproofing membrane) installed over the horizontal flange 111 and vertical flange 113 and abutting the perimeter of the return flange 116, as shown in FIG. 2A. For example, both the right and left vertical sides of the vertical flange 113 can be offset from the right eave and the left eave, respectively, by at least three inches, and the second array of bores 114 can include a first vertical row of bores centered between the right edge of the vertical flange 113 and the right eave and a second vertical row of bores centered between the left edge of the vertical flange 113 and the left eave. In this example, the upper edge of the vertical flange 113 can be offset above the upper eave 118 by two inches; the lower edge of the vertical flange 113 can be offset below the lower eave 119 by three inches; and the second array of bores 114 can include a horizontal row of bores centered between the lower edge of the vertical flange 113 and the lower eave 119, as shown in FIG. 2A.

The outer ends of the eaves—opposite the vertical flange 113—can be finished square. Alternatively, the return flange 116 can include a lip extending laterally outward and toward the perimeter of the vertical flange 113 such that exterior cladding can be finished up to and behind the lip around the full perimeter of the return flange 116, as shown in FIGS. 6A and 6B. For example, stucco can be finished up to and behind the lip around the perimeter of the return flange 116, or rainscreen panels 160 can be installed over the vertical flange 113 and set behind the lip, as shown in FIG. 3B. The return flange 116 can therefore extend outwardly from the outer broad face of the vertical flange 113 by a distance corresponding to (or slightly greater than) the thickness of the exterior cladding specified for the installation such that the exterior cladding and waterproofing barrier can be installed up to each eave and behind the lip of the return flange 116.

In the foregoing implementation, because a lip extending from the upper eave 118 may collect moisture from the face of the exterior cladding above and funnel this moisture behind the cladding and the moisture barrier, the return flange 116 can exclude a lip along the upper eave 118. The upper eave 118 of the return flange 116 can additionally or alternatively include one or more drainage holes passing from the top of the upper eave 118 into the upper capture channel 115A to drain moisture collected by the upper lip. In particular, the mount 110 can include vertical drainage holes in the upper eave 118, through the upper and lower sections of the upper capture channel 115A, and through the upper section of the lower capture channel 115B such that moisture collecting above the upper eave 118, in the upper capture channel 115A, and above the lower capture channel 115B passes vertically downward into the lower capture channel 115B. The lower capture channel 115B can also include drainage features that discharge this moisture—thus collected in the lower capture channel 115B—laterally over the lower eave 119 and out of the mount 110. For example, the lower outer corners of the lower capture channel 115B may not be welded to the return flange 116, thereby preserving a pass-through for moisture collecting in the lower capture channel 115B to drip out of the lower capture channel 115B, over the lower lip extending from the lower eave 119, and onto the exterior cladding below. Alternatively, the lower lip of the capture channel can include a through-bore near each end adjacent the right and left eaves of the return flange 116 such that moisture collecting in the lower capture channel 115B is discharged through these through-bores. Thus, as in the foregoing examples, the mount 110 can define multiple drainage features along or adjacent the lower capture channel 115B such that at least one of the drainage features intersects a low point of the lower capture channel 115B to preserve drainage even when the mount 110 is installed on a sloped surface (e.g., on a staircase or a handicap ramp). However, the mount 110 can include any other suitable number and configuration of draining features on the upper eave 118, the lower eave 119, the upper capture channel 115A, and/or the lower capture channel 115B to release The horizontal flange 111 and the vertical flange 113 can define a singular structure. In one example, 18-gauge steel sheet is cut to size and the first and second arrays of bores are formed, such as by laser-cutting, water-jet cutting, punching, and/or shearing. This sheet is then bent in a sheet metal brake to form the horizontal and vertical flanges 113. Alternatively, the horizontal flange 111 and vertical flange 113 can be formed from disparate structures and welded together. For example: a first plate can be trimmed to size and punched to form the first array of bores 112; a second plate can be trimmed to size and punched to form the second array of bores 114; and the first and second plates can be welded along abutting edges to form the horizontal flange 111 and vertical flange 113, respectively. The upper capture channel 115A and lower capture channel 115B can then be welded onto the vertical flange 113, the upper threaded stud 130A inserted into the upper capture channel 115A, and the lower threaded stud 130B inserted into the lower capture channel 115B. Four separate eaves can then be installed around and welded to the capture channels and to the vertical flange 113, thereby closing the ends of the capture channels. Alternatively, the return flange 116 can be formed and welded into an annular ring before being slipped over and welded to the capture channels, such as with a continuous weld bead or an intermittent weld bead around the perimeter of the return flange 116. However, the mount 110 can be formed and assembled in any other suitable way.

Alternatively, in the variation described above in which the mount 110 includes a single vertical capture channel 115 assembled (e.g., welded) onto the vertical flange 113, the return flange 116 can include: an upper eave 118 that closes the upper end of the vertical capture channel 115; a lower eave 119 that closes the lower end of the vertical capture channel 115; and flanges extending along the vertical sides of the vertical capture channel 115 to meet the upper eave 118 and lower eave 119. The return flange 116 can thus close the ends of the vertical capture channel 115 and can define a flange or "lip" extending about the full perimeter of the vertical capture channel 115. As described above, the upper eave 118 can be perforated to permit moisture infiltrating a gap between the lip of the upper eave 118 and the exterior façade to pass downwardly toward the lower eave 119. The lower eave 119 can be fully welded or otherwise sealed against the lower end of the vertical capture channel 115 to prevent moisture collecting on the lower eave 119 inside the vertical capture channel 115 from exiting the vertical capture channel 115 behind the exterior façade below the lower eave 119; rather moisture that collects on the lower eave 119 inside vertical capture channel 115 can exit the vertical capture channel 115 by flowing down the lower lip of the lower eave 119 and over the exterior façade below. Furthermore, the upper eave 118 and lower eave 119 can be declined toward the front of the vertical capture channel 115 (i.e., away from the vertical flange 113), such as by 5°, such that moisture collecting on the tops of the upper eave 118 and lower eave 119 is funneled toward the front of the capture channel and away from the vertical flange 113, which may prevent moisture from penetrating and collecting behind a waterproofing barrier installed over the vertical flange 113. The mount 110 can then be fabricated as described above.

However, the mount 110 can define any other form and can be fabricated in any other way.

5. Bracket

The bracket 120 of the universal mounting system 100 can include: a first member 121 defining a first slot 122 configured to receive the upper threaded stud 130A and a second slot 123 configured to receive the lower threaded stud 130B, the first slot 122 and the second slot 123 sharing a common radial center; and a second member 124 extending from and substantially perpendicular to the first member 121 and defining an upper receiver 125 and a lower receiver 126 offset below the upper receiver 125, as shown in FIG. 2A. Generally, the bracket 120 functions to couple one or more panels 160 to the mount 110 across a range of roll and depth positions.

In the variation described above in which the mount 110 includes a single vertical capture channel 115, the first member 121 of the bracket 120 is configured to face the vertical capture channel 115 of the mount 110 and defines a first slot 122 and a second slot 123 configured to receive threaded studs extending outwardly from the vertical capture channel 115, as shown in FIG. 1A. For example, the first member 121 of the bracket 120 can define two linear, parallel, and longitudinally-offset slots (the first slot 122 and the second slot 123), as shown in FIG. 1B. The threaded studs 130 can be inserted into the first slot 122 and the second slot 123 and can move vertically within the vertical capture channel 115 over a range of offset distances as the vertical position, lateral position, and roll orientation of the bracket 120 is set relative to the mount 110; nuts can then be tightened onto the threaded studs to fix the bracket 120 in position over the mount 110.

Alternatively, in the variation described above in which the mount 110 includes two distinct capture channels, the first member 121 of the bracket 120 is configured to face the capture channel(s) of the mount 110 and defines a set of radial slots that receive threaded studs extending outwardly from the capture channel(s), as shown in FIG. 2B. The radial slots share a common radial center such that the bracket 120 can pivot relative to the mount 110, such as in a plane parallel to the outer broad face of the vertical flange 113. In one example, the first member 121 of the bracket 120 can be relatively narrow and define two concentric radial slots, each spanning an angular distance of 10° such that the bracket 120 can accommodate 5° of roll adjustment on either side of vertical relative to the mount 110, such as for installation on a balcony or other low-slope structure. In another example, the first member 121 of the bracket 120 can be relatively wide and define two concentric radial slots, each spanning an angular distance of 50° such that the bracket 120 can accommodate 25° of roll adjustment on either side of vertical relative to the mount 110, such as for a handicap ramp or staircase requiring installation of panels 160 on a relatively steep incline.

One variation of the universal mounting system 100 includes a set of brackets 120, each bracket 120 defining radial slots spanning a different angular distance within the set. For example, the set of brackets 120 can include a first bracket 120 defining radial slots spanning 20°, a second bracket 120 defining radial slots spanning 40°, and a third bracket 120 defining radial slots spanning 60° that can be positioned up to 10°, 20°, and 30°, respectively, from either side of vertical on the mount 110. In this example, an installer can select a particular bracket 120—from the set of brackets 120—to accommodate a range of angular positions required for each mount 110 position within an installation.

The first slot 122 and the second slot 123 can be sized for close running fit with the threaded studs installed in the capture channel(s). Alternatively, the first slot 122 and the second slot 123 can each be wider than the diameters of the upper threaded stud 130A and lower threaded stud 130B, respectively, such that bracket 120 can be shifted both laterally and vertically—in addition to rotationally—on the mounts 110. Yet alternatively, rather than radial slots, the first member 121 of the bracket 120 can define a pair of vertical slots configured to receive the threaded studs extending from the mount 110 such that the bracket 120 can be shifted vertically relative to the mount 110. However, the first member 121 of the bracket 120 can include any other number and configuration of slots configured to receive threaded studs extending out of (or threaded fasteners passing into) the capture channel(s).

The second member 124 of the bracket 120 extends from and is substantially perpendicular to the first member 121. In one implementation, the first member 121 and the second member 124 define a unitary structure, such as cut from a single section of angle iron or formed (e.g., bent) from steel plate. Alternatively, the first member 121 and the second member 124 of the bracket 120 can be fabricated by welding the first member 121 to the second member 124.

The upper receiver 125 of the second member 124 of the bracket 120 can define a horizontally-elongated slot such that a fastener passing through the upper receiver 125 and a corresponding bore in an adjacent panel 160 can be shifted inward toward and outward in the horizontal plane relative to the mount 110. The lower receiver 126 of the second member 124 can be of similar geometry and can be offset below the upper receiver 125. Thus, for a set of mounts 110 and panels 160 installed in series along the perimeter of a balcony or other structure, fasteners that fix each plate to a corresponding bracket 120 can be shifted along the upper receiver 125 and lower receiver 126 to set the depth positions of the panels 160 on their respective mounts 110, such as to align the broad faces of the panels 160 in a vertical plane. Alternatively, the upper receiver 125 and the lower receiver 126 can define circular bores that are oversized for their designated fasteners; fasteners installed in the upper receiver 125 and the lower receiver 126 can thus be adjusted vertically and longitudinally within their respective oversized receivers. However, the second member 124 of the bracket 120 can define one or more receivers or any other geometry and position to couple one or more adjacent panels 160 to the mount 110.

The universal mounting system 100 can also include a set of fasteners that mount 110 the panel 160 to the bracket 120. In one implementation, the universal mounting system 100 includes: a threaded bolt, a flat washer, a lock washer, and a threaded nut designated for the upper receiver 125; and a sex bolt 140 defining a center cylinder of a first diameter terminating on each end in larger-diameter flanges, separable into two halves, and designated for the lower receiver 126, as shown in FIG. 3C. In this implementation: the sex bolt 140 can be installed in the lower receiver 126 of the bracket 120; the panel 160 can be lowered over the bracket 120 to seat the open slot 162 in the panel 160 onto the center cylinder of the sex bolt 140 and the threaded bolt, flat washer, lock washer, and threaded nut can then be installed in the closed slot 161 in the panel 160 and the upper receiver 125 in the bracket 120 to constrain the panel 160 on the bracket 120, as shown in FIG. 3C. The sex bolt 140 can therefore pivotably support the panel 160 to the bracket 120 while an installer inserts the threaded bolt through the upper receiver 125 in the bracket 120 and the closed slot 161 in the panel 160, thereby enabling the installer to complete installation of the panel 160 with two hands and without assistance from another installer, as described above. In this implementation, the sex bolt 140 can alternatively be installed in the upper receiver 125, or the second member 124 of the bracket 120 can define a single receiver and can include a cylinder welded to the bracket 120—in place of a sex bolt 140—to engage and constrain an open slot 162 in an adjacent panel 160.

In one implementation, the bracket 120 includes a third member, which extends from and is substantially perpendicular to the first member 121 and is opposite the second member 124. The third member is similar to the second member 124 in that the third member can define a unitary structure with the first member 121 and the second member 124, such as cut from a single section of angle iron or formed (e.g., bent) from steel plate. The third member defines a second upper receiver 125 and a second lower receiver 126 opposite the upper receiver 125 and the lower receiver 126 of the second member 124. Therefore, a panel 160, post, or any other component configured to attach to the bracket 120 can be inserted between the second member 124 and the third member of the bracket 120 and fastened, via the aforementioned fasteners passing through the upper receiver 125 of the second member 124 and the third member and through the lower receiver 126 of the second member 124 and the third member.

6. Panel

The panel 160 of the universal mounting system 100 includes a projection defining an open slot 162 and a closed slot 161 configured to receive a set of fasteners (e.g., a threaded bolt and a sex bolt 140) passing through the upper receiver 125 and the lower receiver 126 of the bracket 120. Generally, the panel 160 defines an integrated banister and balustrade unit (or "guardrail panel 160") configured for installation on the bracket 120. In one implementation, the universal mounting system 100 includes multiple identical panels 160 installed in series along a structure to form a continuous guardrail.

A panel 160 in the universal mounting system 100 can be formed by cutting and bending sheet metal into a singular structure defining a banister and balustrade. For example, the panel 160 can be formed from 18-gauge cold-rolled steel sheet or 14-gauge aluminum sheet. Each side of the panel 160 can also be bent—such as at a 90° angle—and welded along its corners to form a continuous flange around the perimeter of the panel 160, and the right and left flanges of the panel 160 defining later projections that each include an open slot 162 and a closed slot 161, as described below. Alternatively, the panel 160 can be fabricated from multiple elements. For example, the panel 160 can include a banister, a set of balustrades, two end uprights, and a lower beam welded, brazed, or riveted into a single panel 160, wherein end upright defines a projection including an open slot 162 and a closed slot 161 that cooperate to mount the corresponding side of the panel 160 to a bracket 120 in the universal mounting system 100, as described below. However, a panel 160 in the universal mounting system 100 can be formed or fabricated in any other suitable way and in any other suitable material, and the panel 160 can be plated, coated, painted, or finished in any other suitable way.

The panel 160 can therefore include a projection (i.e., a flange) extending rearward (e.g., at an angle of 90° from the outer broad face of the panel 160) from each vertical side of the panel 160 to meet the second member 124 of an adjacent bracket 120. Each projection on the panel 160 can define a set of bores or slots that align with corresponding receivers in the adjacent bracket 120. For example, a projection on a side of the panel 160 can include: a vertically elongated closed slot 161 configured to align with the upper receiver 125 of an adjacent bracket 120; and an L-shaped open slot configured to align with the lower receiver 126 of an adjacent bracket 120, as shown in FIG. 3C. In this example, the L-shaped open slot can extend horizontally from the trailing edge of the projection toward the front of the panel 160 and end vertically upward along the projection; the panel 160 can thus be installed on a bracket 120 by sliding the L-shaped open slot laterally over a sex bolt 140—previously installed in the lower receiver 126 of the bracket 120, as described above—and then lowering the panel 160 downward until the sex bolt 140 seats in the top of the open slot 162. In this example, a fastener can then be installed through the upper receiver 125 of the bracket 120 and the closed slot 161 in the projection on the panel 160 to fix the panel 160 to bracket 120. The open slot 162 and the closed slot 161 can define vertical heights exceeding the diameters of the fastener and the sex bolt 140, respectively, to accommodate vertical adjustment of the panel 160 relative to the bracket 120; the panel 160 can therefore be shifted vertically relative to the bracket 120 to set its vertical position on the balcony or other structure before the fastener is tightened.

For a panel 160 including a first projection installed substantially perpendicular to the outer broad face of the vertical flange 113 of an adjacent mount 110, the first projection of the panel 160 can further include a lip extending along and substantially perpendicular to the first projection, and the lip can define the open slot 162 and the closed slot 161 for this first side of the panel 160, as shown in FIG. 4. For example, for an installation including a mount 110 and a bracket 120 installed on a rightmost floor joist adjacent a right outer corner of a balcony, a first panel 160 designated for installation along the right floor joist (i.e., along the side of the balcony), and a second panel 160 designated for installation along a rim joist (i.e., along the front of the balcony), the right projection on the first panel 160 can be perpendicular to the inner broad face of the first panel 160 and can define a first open slot 162 and a first closed slot 161. However, in this example, the second panel 160 can include a lip extending from its left projection substantially parallel to and offset behind the inner broad face of the second panel 160, wherein the lip defines a second open slot 162 and a second closed slot 161, as shown in FIG. 4. The lip of the left projection on the second panel 160 can thus mount 110 on the bracket 120 immediately opposite the right projection of the first panel 160. In particular, in this example, the first and second panels 160 can be installed around a 90° corner and mounted to the bracket 120 via a single sex bolt 140 and a single threaded fastener, as shown in FIG. 4. However, each panel 160 in the universal mounting system 100 can include one or more projections and/or lips extending from the inner broad face of the panel 160 at any other angle to accommodate installation around a vertex of any other included angle.

7. Field Measurements

In one variation, the universal mounting system 100 further includes one or more reference markers for recording relative positions of mounting brackets 120 installed across a structure (e.g., around the perimeter of a balcony). Generally, the universal mounting system 100 can include one or more reference markers that enable quick, repeatable manual field measurements across an installation, such as center-to-center distances between mounts 110. For example, a mount 110, bracket 120, and panel 160 assembly can be associated with known pitch, yaw, roll, vertical, horizontal (i.e., lateral), and depth (i.e., longitudinal) adjustment ranges—relative to the reference marker on the mount 110 or on the bracket 120—for the panel 160. Thus, once a set of mounts 110 is installed, such as on a balcony, deck, or staircase, the installer can measure center-to-center, vertical, horizontal, and depth distances between reference markers across the set of installed mounts 110. These "field measurements" can then be combined with the known adjustment ranges for the mount 110 assemblies to determine a single panel 160 geometry (e.g., width, height, projection depth, and the open and closed slot position) or a limited number of panel 160 geometries that can be fabricated to fit the installation.

In one implementation, the mount 110 includes a tongue, dimple, or other fiducial extending outwardly from or arranged on the return flange 116 such that the fiducial is physically accessible even after exterior cladding is installed over the vertical and horizontal flanges 113, such as shown in FIG. 2B. Thus, in this implementation, an installer can record distances between fiducials on adjacent mounts 110 following installation of the mounts 110 and exterior cladding and before installation of the brackets 120 and panels 160. Once field measurements are thus recorded, the geometries for panels 160 in the installation—such as width, height, and/or positions of open and closed slots—can be defined and ordered. For example, the field measurements can be uploaded into a geometry engine that merges the field measurements with the known adjustment ranges for the mount 110 assemblies to calculate a specific width, height, projection depth, open slot position, and closed slot position for all panels 160 in the installation. Panels 160 can then be fabricated according to these dimensions and then installed on the brackets 120, as described above.

In the foregoing variation, the field measurements can alternatively be recorded between reference markers defined on brackets 120 installed on mounts 110 across an installation. For example, the bracket 120 can include a physical fiducial, as described above, and an installer can thus install the bracket 120 loosely on the mount 110 in an approximate final position and then record field measurements between fiducials across adjacent brackets 120 within the installation. In this implementation, the bracket 120 can also cooperate with the mount 110 to visually indicate its relative angular position on the mount 110.

In one example implementation, the universal mounting system 100 further includes an indicator washer configured for installation on the upper threaded stud 130A or the lower threaded stud 130B and between a threaded nut and the bracket 120, as shown in FIG. 2B. In this example implementation, the upper threaded stud 130A can define a flat along its length, and the indicator washer can define an internal d-shape section that, when installed between the first member 121 of the bracket 120 and a threaded nut, is constrained in rotation by the flat on the upper threaded stud 130A, which is similarly constrained in rotation by the upper capture channel 115A. Alternatively, the upper threaded stud 130A can define a groove along its length, and the indicator washer can define an internal tab washer that is constrained in rotation by the groove in the upper threaded stud 130A, as shown in FIG. 2B. In this example implementation, the bracket 120 can include a radial scale embossed, debossed, printed, or otherwise applied to the first member 121 proximal the first slot 122, and the washer can include a needle, a point, or an embossed or debossed marker that indicates a particular angle on the radial scale corresponding to the angular position of the bracket 120 relative to the mount 110, as shown in FIG. 2B. Thus, when the mount 110, the bracket 120, and the washer are assembled, an installer can read the position of the marker on the washer along the radial scale to determine the angular position of the bracket 120 relative to the mount 110 without additional tools or metrology equipment.

In another example implementation, the bracket 120 includes a graduated angle gauge embossed, debossed, printed, or otherwise applied to the first member 121 between the upper receiver 125 and lower receiver 126. In this implementation, the mount 110 also includes a gauge needle extending from the vertical center of one side of the return flange 116 and over the first member 121 of the bracket 120 once installed; the gauge needle thus indicates a reading on the graduated angle gauge corresponding to the relative angle of the bracket 120 on the mount 110. For example, the mount 110 can include an elongated needle spot welded to the right eave of the return flange 116 between the upper capture channel 115A and the lower capture channel 115B, extending horizontally outward from the return flange 116, and cutting back laterally toward the opposite left eave of the return flange 116 to meet the graduated angle gauge on the installed bracket 120. Thus, in this example implementation, the needle can indicate the relative angular position of the bracket 120 on the mount 110 despite the lateral position of the bracket 120 on the mount 110.

In yet another example implementation, the universal mounting system 100 includes a drop gauge configured for installation between the upper threaded stud 130A and the lower threaded stud 130B. In this example implementation, the bracket 120 similarly includes a graduated angle gauge embossed, debossed, printed, or otherwise applied to the first member 121 between the upper receiver 125 and the lower receiver 126, and the drop gauge can define an upper bore configured to receive the upper threaded stud 130A, a lower elongated slot configured to receive the lower threaded stud 130B, and an indicator configured to indicate a reading on the graduated angle gauge corresponding to the relative angle of the bracket 120 on the mount 110.

However, the universal mounting system 100 can include any other type or configuration of reference markers, gauge, or indicators to support recordation of relative positions of mounts 110 and/or brackets 120 across an installation.

As a person skilled in the art will recognize from the previous detailed description and from the figures and claims, modifications and changes can be made to the embodiments of the invention without departing from the scope of this invention as defined in the following claims.

We claim:

1. A universal mounting system comprises:

a mount comprising:

a horizontal flange defining a first array of bores;

a vertical flange extending below and substantially perpendicular to the horizontal flange and defining an outer broad face and a second array of bores across the outer broad face;

a vertical capture channel arranged on the outer broad face;

a return flange extending from a perimeter of the vertical capture channel and substantially parallel to and offset from the outer broad face;

an upper threaded fastener captured by and running in the vertical capture channel; and a lower threaded fastener captured by and running in the vertical capture channel below the upper threaded fastener;

a bracket:

comprising a first member defining a first slot and a second slot;

comprising a second member extending from and substantially perpendicular to the first member and defining an upper receiver and a lower receiver offset below the upper receiver; and configured to fasten to the upper threaded fastener via the first slot and to fasten to the lower threaded fastener via the second slot;

a panel comprising a projection defining an open slot and a closed slot and configured to fasten to the upper receiver of the second member via the open slot and to fasten to the lower receiver of the second member via the closed slot.

2. The universal mounting system of claim 1, wherein:

the closed slot comprises a bore on the panel configured to align with the upper receiver; and the open slot comprises an L-shaped slot, opening to an edge of the projection, and configured to align with the lower receiver.

3. The universal mounting system of claim 1, further comprising:

a threaded bolt and a first threaded nut configured to fasten the closed slot of the panel to the upper receiver of the bracket; and a sex bolt defining a center cylinder terminating on each end in larger-diameter flanges, separable into two halves, configured to fasten the open slot of the panel to the lower receiver of the bracket, and configured to pivotably support the panel during insertion of the threaded bolt through the upper receiver and the closed slot of the panel.

4. The universal mounting system of claim 2, wherein the panel is fastened to the bracket via:

the first threaded nut tightened over the panel and the second member of the bracket and onto the threaded bolt passing through the closed slot of the panel and the upper receiver of the second member of the bracket; and the sex bolt passing through the open slot of the panel and the lower receiver of the bracket to rotationally constrain the panel about the first threaded nut.

5. The universal mounting system of claim 4, wherein the bracket is fastened to the mount via a second threaded nut tightened over the first member of the bracket and onto the upper threaded fastener passing through the first slot of the first member of the bracket, and a third threaded nut tightened over the first member and onto the lower threaded fastener extending through the second slot of the first member of the bracket.

6. A universal mounting system comprises:

a mount comprising:

a horizontal flange defining a first array of bores;

a vertical flange extending below and substantially perpendicular to the horizontal flange and defining an outer broad face and a second array of bores across the outer broad face;

a vertical capture channel arranged on the outer broad face;

a return flange extending from a perimeter of the vertical capture channel and substantially parallel to and offset from the outer broad face;

an upper threaded fastener captured by and running in the vertical capture channel; and a lower threaded fastener captured by and running in the vertical capture channel below the upper threaded fastener;

a bracket:

comprising a first member defining a first slot and a second slot;

comprising a second member extending from and substantially perpendicular to the first member and defining an upper receiver and a lower receiver offset below the upper receiver; and configured to fasten to the upper threaded fastener via the first slot and to fasten to the lower threaded fastener via the second slot.

7. The universal mounting system of claim 6, further comprising a panel comprising a projection defining an open slot and a closed slot and configured to fasten to the upper receiver of the second member via the closed slot and to fasten to the lower receiver of the second member via the open slot.

8. The universal mounting system of claim 6, wherein:

the bracket further comprises a third member extending from and substantially perpendicular to the first member, opposite the second member, and defining a second upper receiver aligned with the upper receiver and a second lower receiver offset below the second upper receiver and aligned with the lower receiver; and the bracket is configured to fasten to a post inserted between the second member and the third member of the bracket.

9. The universal mounting system of claim 6, wherein the first member defines:

the first slot comprising a first linear slot; and the second slot comprising a second linear slot parallel to and vertically offset from the first linear slot.

10. The universal mounting system of claim 6, wherein the return flange is offset from the outer broad face by an offset distance greater than a combined thickness of exterior cladding and a moisture barrier.

11. The universal mounting system of claim 10, wherein an internal surface of the return flange is configured to constrain exterior cladding and the moisture barrier against the outer broad face, the exterior cladding and the moisture barrier installed between the return flange and the outer broad face and abutting the vertical capture channel.

12. The universal mounting system of claim 6, further comprising an annular eave surrounding the vertical capture channel extending from the outer broad face and coupled to the return flange.

13. The universal mounting system of claim 12, wherein the annular eave comprises:

an upper eave substantially parallel to the horizontal flange and enclosing the upper threaded fastener and the lower threaded fastener within the vertical capture channel at an upper end of the vertical capture channel; and a lower eave substantially parallel to the horizontal flange and enclosing the upper threaded fastener and the lower threaded fastener within the vertical capture channel at a lower end of the vertical capture channel.

14. The universal mounting system of claim 13, wherein the upper eave defines a drainage hole configured to pass water collecting on the upper eave to drain into the vertical capture channel.

15. The universal mounting system of claim 6, wherein:

each bore in the first array of bores is configured to receive a nail driven through the bore and into a substrate; and each bore in the second array of bores is countersunk and configured to receive a screw driven through the bore and into the substrate with a head of the screw substantially flush with the vertical flange.

16. The universal mounting system of claim 6, wherein each bore in the first array of bores and the second array of bores is countersunk and configured to receive a countersunk self-tapping concrete anchor driven through the bore and into a concrete substrate.

17. The universal mounting system of claim 6, wherein:

the horizontal flange and the vertical flange define a unitary structure of formed metal plate; and the first member and the second member define a unitary structure.

18. The universal mounting system of claim 6, wherein the first member further defines reference markers indicating a pitch angle of the bracket fastened to the mount.

19. A universal mounting system comprises:

a mount comprising:

a horizontal flange defining a first array of bores;

a vertical flange extending below and substantially perpendicular to the horizontal flange, defining an outer broad face and a second array of bores across the outer broad face;

an upper horizontal capture channel arranged on the outer broad face;

a lower horizontal capture channel arranged on the outer broad face below and parallel to the upper horizontal capture channel, an annular eave extending from the outer broad face and arranged about the upper capture channel and the lower capture channel;

an upper threaded fastener captured by and running in the upper horizontal capture channel; and a lower threaded fastener captured by and running in the lower horizontal capture channel;

a bracket:

comprising a first member defining a first radial slot and a second radial slot;

comprising a second member extending from and substantially perpendicular to the first member and defining an upper receiver and a lower receiver offset below the upper receiver; and configured to fasten to the upper threaded fastener via the first slot and to fasten to the lower threaded fastener via the second slot; and a panel comprising a projection defining an open slot and a closed slot configured to receive a set of fasteners passing through the upper receiver and the lower receiver.

20. The universal mounting system of claim 19, wherein the annular eave comprises:

a left eave substantially perpendicular to the horizontal flange and the vertical flange and enclosing the upper threaded fastener in the upper capture channel at a left end of the upper capture channel and the lower threaded fastener within the lower capture channel at a left end of the lower capture channel; and a right eave substantially perpendicular to the horizontal flange and the vertical flange and enclosing the upper threaded fastener in the upper capture channel at a right end of the upper capture channel and the lower threaded fastener within the lower capture channel at a right end of the lower capture channel.

* * * * *